US007159406B2

(12) United States Patent
Schuchart

(10) Patent No.: US 7,159,406 B2
(45) Date of Patent: Jan. 9, 2007

(54) WATER DELIVERY SYSTEM WITH ANTI-KINK DEVICE FOR A REFRIGERATOR

(75) Inventor: Ryan D. Schuchart, Cedar Rapids, IA (US)

(73) Assignee: Maytag Corporation, Newton, IA (US)

( * ) Notice: Subject to any disclaimer, the term of this patent is extended or adjusted under 35 U.S.C. 154(b) by 150 days.

(21) Appl. No.: 11/033,560

(22) Filed: Jan. 12, 2005

(65) Prior Publication Data

US 2006/0150658 A1 Jul. 13, 2006

(51) Int. Cl.
*F25C 1/00* (2006.01)

(52) U.S. Cl. ..... 62/66; 62/337; 62/340

(58) Field of Classification Search ..... 62/66, 62/337–340; 248/49, 65, 73, 75
See application file for complete search history.

(56) References Cited

U.S. PATENT DOCUMENTS

| | | | | |
|---|---|---|---|---|
| 124,897 | A | 3/1872 | Honsinger | |
| 1,156,145 | A | 10/1915 | Jenkins | |
| 2,853,262 | A | 9/1958 | Reimann | |
| 4,151,864 | A | 5/1979 | Thurman | |
| 4,163,457 | A | 8/1979 | Rickel et al. | |
| 4,318,519 | A | 3/1982 | Blevins | |
| 4,367,967 | A | 1/1983 | Albert, Jr. | |
| 4,433,821 | A | 2/1984 | Bolding et al. | |
| 6,303,031 | B1 * | 10/2001 | Senner | 210/232 |
| 6,352,224 | B1 | 3/2002 | Collins | |
| 6,467,734 | B1 | 10/2002 | Brown et al. | |
| 6,604,890 | B1 * | 8/2003 | Tresch | 405/184.4 |
| 6,705,346 | B1 * | 3/2004 | Kordon | 137/625.5 |
| 2001/0038059 | A1 | 11/2001 | Dick et al. | |

FOREIGN PATENT DOCUMENTS

| | | |
|---|---|---|
| JP | 2003072893 | 12/2003 |

* cited by examiner

*Primary Examiner*—William E. Tapolcai
(74) *Attorney, Agent, or Firm*—Diederiks & Whitelaw PLC

(57) ABSTRACT

A system for delivering water to a water dispenser or an icemaker of a refrigerator includes at least one anti-kink device employed in routing a water line. In accordance with a preferred embodiment, the anti-kink device is attached to a support bracket for a valve of the water delivery system and aids in routing the water line adjacent an attachment of the water line to the valve. In addition to preventing kinking, the anti-kink device ensures proper water line/valve alignment to prevent side loading of the water line.

23 Claims, 7 Drawing Sheets

WATER DELIVERY SYSTEM WITH ANTI-KINK DEVICE FOR A REFRIGERATOR

BACKGROUND OF THE INVENTION

1. Field of the Invention

The present invention pertains to the art of refrigerators and, more particularly, to a refrigerator water delivery system incorporating at least one anti-kink device for a water line of the system.

2. Discussion of the Invention

Providing water dispensers and automatic icemakers in household refrigerators has become extremely commonplace. In addition, there is a growing trend toward increasing the purity of all consumed water. For at least these reasons, it has heretofore been proposed in the art to incorporate a water purifying system in a refrigerator in order to filter the water supplied to a water dispenser and/or icemaker. To this end, filter assemblies have been installed during the overall manufacturing of refrigerators, while utilizing filters which can be fairly, readily accessed for replacement directly by consumers.

The inclusion of water and/or ice dispensers requires the routing of water lines in connection with the manufacturing process. Adding a water filter simply adds additional routing requirements. In general, plastic tubing is employed for the water lines. Mainly due to the flexibility of the tubing, care must be taken to ensure proper alignment of the water lines to valves and to prevent kinking of the water lines. If the water line is not properly aligned with a valve fitting, a leak may occur. Improper alignment results in side loading which, over time, can cause the water line/valve connection to degrade and leak. Likewise, it is important to ensure that the water line does become kinked during or after installation. A kink in the water line will restrict water flow and also possibly create a leak in the water line. The potential for a water line kink is particularly prevalent adjacent connections of the water line to a valve. Obviously, one kink in a supply line can significantly limit the effective operation of many dispensing components.

Based on the above, there exists a need in the art for an enhanced water delivery system for a refrigerator, particularly a delivery system employing one or more anti-kink devices which prevent kinks from developing in one or more water lines, particularly at crucial connection locations of the system.

SUMMARY OF THE INVENTION

The present invention is directed to a water delivery system, including one or more anti-kink devices, for effectively delivering water to a water dispenser or an icemaker in a refrigerator. The water delivery system includes a water line having an inlet adapted to be connected to fresh water supply and a water outlet leading to at least one of a water dispenser and an icemaker. At least one anti-kink device is provided in the routing path of the water line to prevent kinking of the line.

In accordance with a preferred embodiment of the invention, the water line is initially routed to a main flow control valve having support structure to which is attached a first anti-kink device. An outlet from the main flow control valve leads to a dual water flow valve which, in turn, can provide a fluid connection to either the water dispenser or the icemaker. At each valve, an anti-kink device is provided which prevents the water line(s) from developing a kink near a respective connection location of the water line to the valve. In addition to ensuring that the water line(s) remain kink-free near the valves, the anti-kink devices ensures a proper water line/valve alignment.

Additional objects, features and advantages of the water delivery system and anti-kink arrangement of the invention will become more readily apparent from the following detailed description of a preferred embodiment, when taken in conjunction with the drawings wherein like reference numerals refer to corresponding parts in the several views.

DETAILED DESCRIPTION OF THE PREFERRED EMBODIMENT

Figure 1:
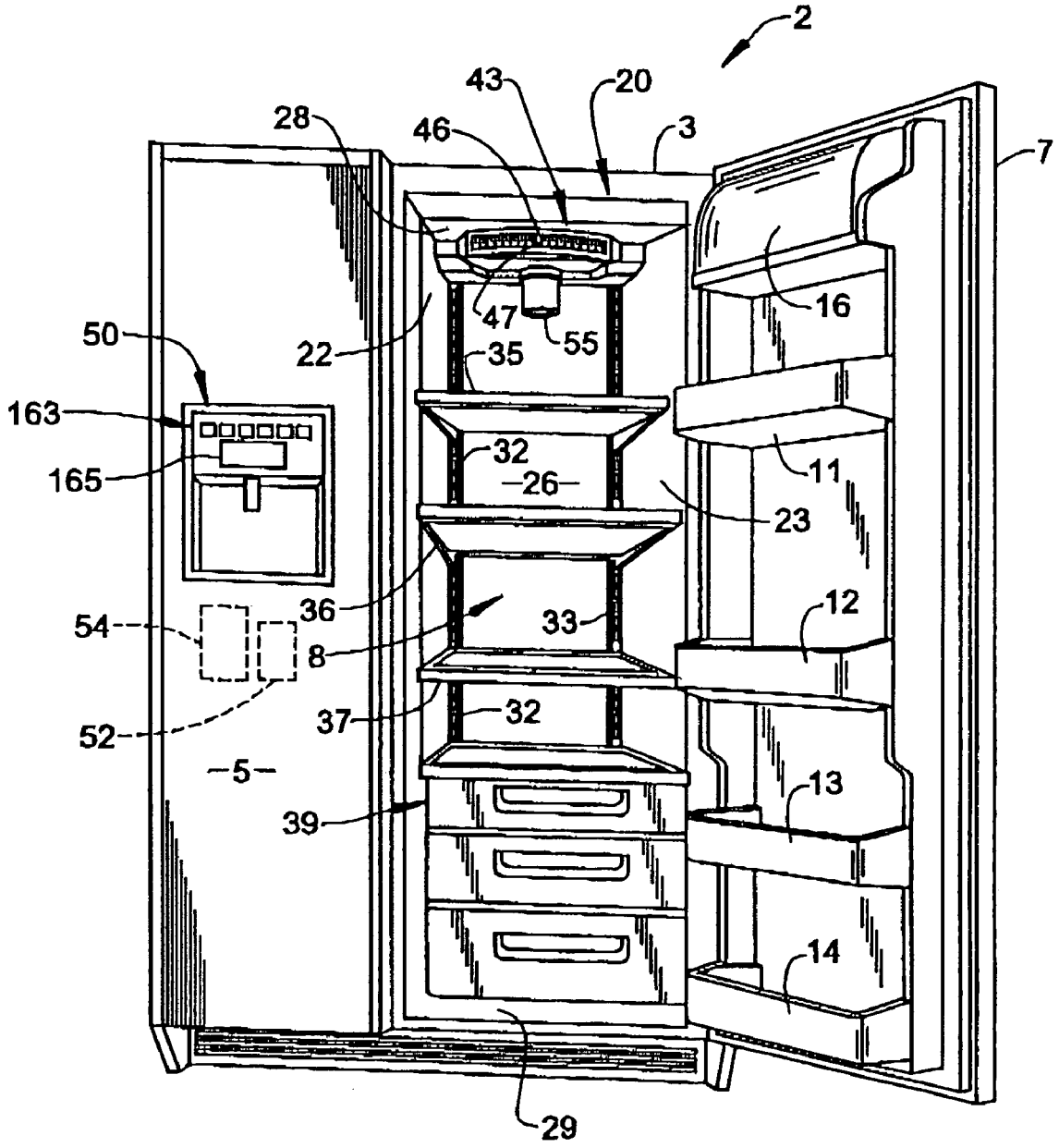
FIG. 1 is a perspective view of a side-by-side refrigerator incorporating a water delivery system with anti-kink devices constructed in accordance with the present invention.

With initial reference to FIG. 1, a side-by-side refrigerator is generally indicated at 2. In a manner widely known in the art, a side-by-side refrigerator 2 is formed from a cabinet shell 3 to which is pivotably attached a freezer compartment side door 5 and a fresh food compartment side door 7. Side door 7 is shown open to expose a fresh food compartment 8 defined within cabinet shell 3. Fresh food compartment side door 7 supports a plurality of vertically spaced shelves 11–14 and is also preferably provided with a dairy compartment 16. In a preferred embodiment, fresh food compartment 8 is formed from an integral liner 20 having opposed side walls 22 and 23, a rear wall 26 and top and bottom walls 28 and 29. Secured to rear walls 26 by means of mechanical fasteners (not shown) are a pair of laterally spaced and vertically extending rails 32 and 33 that adjustably support various vertically spaced shelves 35–37, as well as a shelf supporting bin assembly generally indicated at 39.

Also shown mounted within fresh food compartment 8 at top wall 28 is a temperature control unit 43. Temperature control unit 43 is preferably molded of plastic and includes upper and lower slidable temperature control members 46 and 47 which can be used by a consumer to adjust the temperatures within side-by-side refrigerator 2 to preferable levels. As also shown in this figure, freezer compartment side door 5 is preferably provided with a dispensing unit 50 which can be used to selectively dispense either water or ice.

In general, the above-described structure of side-by-side refrigerator 2 is known in the art and does not form part of the present invention. Instead, this description is provided for the sake of completeness. The present invention is particularly directed to a water delivery system, which employs one or more anti-kink devices generally indicated at 52 and 54 and described in full hereinafter, for supplying water either directly to dispensing unit 50 or to an automatic icemaker. Also part of the water delivery system is a replaceable filter, generally indicated at 55 in FIG. 1. As shown, filter cartridge 55 preferably projects downward from within the housing of temperature control unit 43 at a central rear portion of fresh food compartment 8. This location is considered to advantageously provide a readily visible and easily accessible filter cartridge 55 that can be replaced by a consumer as needed. However, other locations for replaceable filter 55 could be employed. Again, this structure is generally known in the art and only provided here for the sake of completeness.

Figure 2:
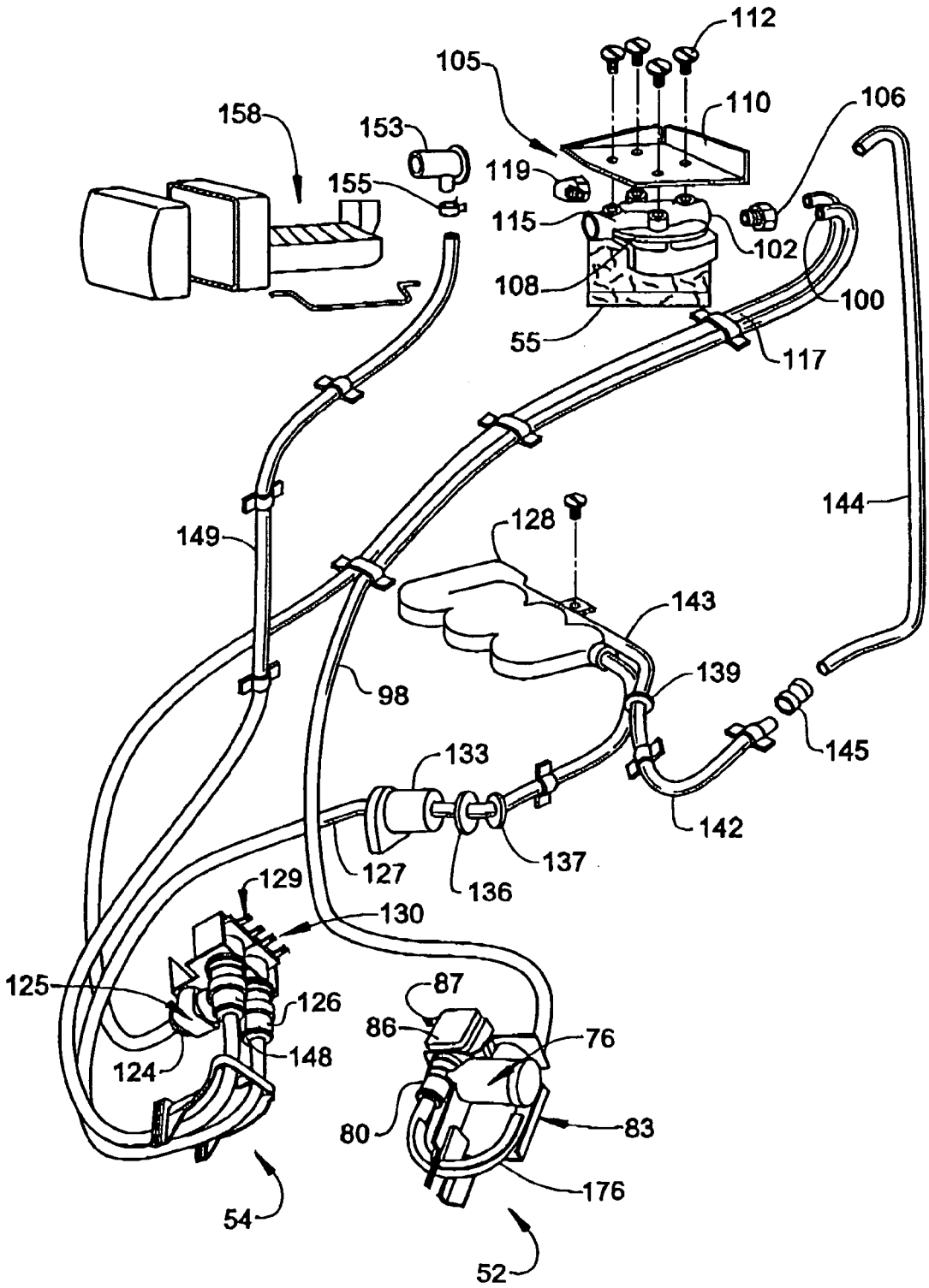
FIG. 2 is an exploded view of the water delivery system with the anti-kink devices of the invention.

Reference will now be made to FIG. 2 in detailing the overall components and their interconnections for the water delivery system of the present invention. In accordance with the preferred form of the invention, a water supply (not shown) is attached to refrigerator 2 at single valve 76. More specifically, single valve 76 includes an inlet (not shown) for attachment of the supply line, as well as an outlet 80. Valve 76 is mounted on refrigerator 2 by means of bracket 83 and preferably constitutes a solenoid-type valve 86 having electrical connectors 87 which can be utilized to fluidly interconnect outlet 80 in a manner which will be described more fully below. Outlet 80 is connected to water delivery tube 98. Tube 98 has a terminal end 100 that is connected to a water inlet 102 of a filter cartridge mounting head 105 through a connector 106.

Filter cartridge mounting head 105 is used to support filter cartridge 55 and therefore it is preferably mounted so as to be at least partially enclosed by a portion of temperature control unit 43. In any event, mounting head 105 includes a main body 108 which is preferably injection molded of plastic and attached to a bracket 110 by means of various screws 112. In addition to water inlet 102, mounting head 105 has associated therewith a water outlet 115 to which is attached a tube 117 by means of an elbow connector 119. Tube 117 is preferably formed from plastic having a diameter of approximately 0.25 inches (6.35 mm). The manner in which water flows through mounting head 105 from tube 98 to tube 117 is known in the art and therefore will not be further discussed. An opposing end of tube 117 is connected to an inlet port 124 of a dual dispenser valve 125. Dispenser valve 125 includes a first outlet 126 which is connected through a conduit 127 that leads to a water tank 128. In a manner known in the art, water tank 128 is preferably mounted within fresh food compartment 8, such as at lower rear portion thereof. In any event, dispenser valve 125 is preferably a solenoid-type valve having electrical connectors, such as those indicated at generally 129 and 130.

Since both valves 76 and 125 are preferably located outside of fresh food compartment 8, conduit 127 has positioned therealong a spacer 133 that extends through liner 20 to permit sealing around conduit 127 during the injection molding of foamed insulation within cabinet 3 in a manner widely known in the art. For additional sealing purposes, seals 136, 137 and 139 are also provided. Seal 139 is actually associated with a tube 142 that leads from water tank 128 to dispensing unit 50. More specifically, tube 142 includes a first section 143 that is interconnected to a second section 144 through a connector 145. Second section 144 of tube 142 directly leads to water dispensing unit 50. Dispenser valve 125 also includes a second outlet 148 to which is attached a tube 149 that leads to a nozzle 153. More specifically, tube 149 is attached to nozzle 153 by means of a clamp 155, with nozzle 153 being utilized to provide a flow of water to an icemaker generally indicated at 158.

With this arrangement, water supplied to refrigerator 2 is first delivered to valve 76. Regardless of whether water is needed at dispenser unit 50 or icemaker 158, valve 76 preferably directs the water to mounting head 105. Mounting head 105 normally has filter cartridge 55 attached thereto, such that water flowing into inlet 102 through tube 98 would be forced to flow through filter cartridge 55 and thereafter delivered to water outlet 115. In any case, all of the water for either dispensing unit 50 or icemaker 158 is directed through mounting head 105 and, so long as the consumer has attached a suitable filter cartridge 55, the purity of the water delivered to either dispensing unit 50 or icemaker 158 will be enhanced. The filtered water is then delivered through tube 117 to dispenser valve 125 which controls whether the water would flow to water tank 128 and then dispenser unit 50 or to icemaker 158.

Based on the above, two valves 76 and 125 are utilized to control the flow of water in the overall water circuit. These multiple valves are utilized in order to separate the electrical nodes and allow the water to flow to a desired destination. However, it should be recognized that there are various other types of water circuit arrangements which could be devised to perform this function. In fact, a simple system for a refrigerator just having either a dispenser unit or icemaker need only employ valve 76. In addition, a refrigerator having both a dispenser and icemaker, but no filter, need only employ valve 125.

At this point it should be noted that the general configuration of the water delivery system as described above is known and set forth in U.S. Pat. No. 6,303,031 which is incorporated herein by reference. Therefore, this discussion has been included for the sake of completeness. The present invention is more particularly directed to the inclusion and use of anti-kink devices 52 and 54 in connection with the routing of the various water lines as will now be described in full detail.

Figure 3:
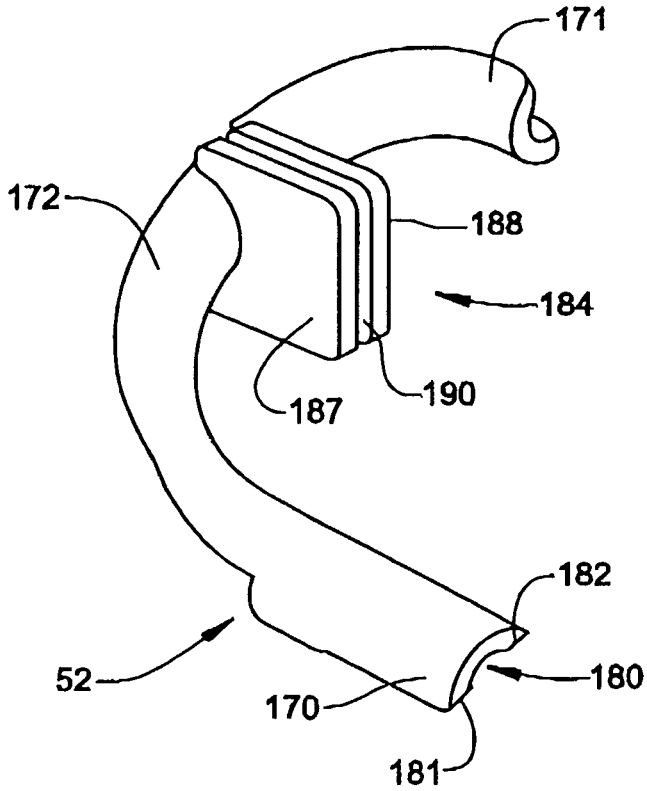
FIG. 3 is a perspective view of one anti-kink device of the invention.
Figure 5:
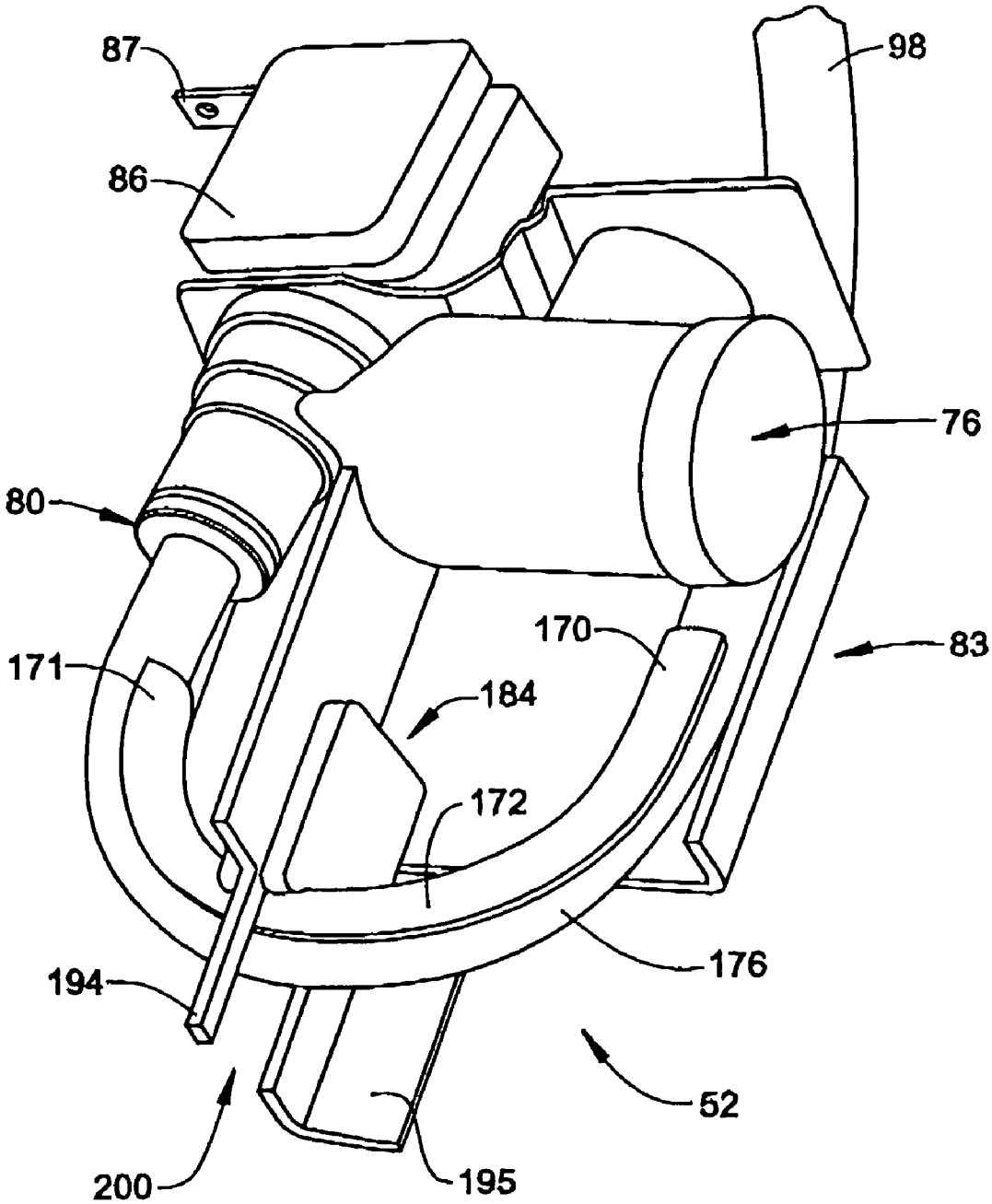
FIG. 5 is a perspective view of a single water valve unit incorporating the anti-kink device of FIG. 3.

Reference will now be made to FIGS. 3 and 5 in describing the preferred construction and use of anti-kink device 52. In accordance with the invention, anti-kink device 52 includes a first end portion 170 leading to a second end portion 171 through a center section 172. Center section 172 is arcuate so as to establish a generally U-shape for anti-kink device 52. As best shown in FIG. 5, an end portion 176 of water line 98 passes about center section 172 of anti-kink device 52. Actually, end portion 176 is positioned within a trough 180 that extends from first end portion 170 to second end portion 171. Trough 180 is defined by arcuate wall members 181 and 182. Trough 180 serves to position and guide end portion 176 of water line 98 over anti-kink device 52, particularly by conforming to the size and shape of water line 98. In addition to preventing water line 98 from kinking, trough 180 ensures a proper alignment between end portion 176 and outlet 80 of valve 76.

Anti-kink device 52 is secured and/or attached to bracket 183 through a mounting member 184. In accordance with a preferred form of the invention, mounting member 184 includes first and second finger elements 187 and 188 that are cantilevered from center section 172. First and second finger elements 187 and 188 are spaced from one another so as to define a channel 190. As best shown in FIG. 5, when anti-kink device 52 is attached to bracket 83, first and second finger elements 187 and 188 span a portion (not separately labeled) of bracket 83. Actually, bracket 83 is provided with first and second extension members 194 and 195 that are spaced from one another so as to define a slot 200. With this arrangement, mounting member 184 is positioned in slot 200 such that first and second finger members 187 and 188 sandwich a portion of bracket 83, with both a portion of center section 172 and end portion 176 of water line 98 extending into slot 200.

Figure 4:
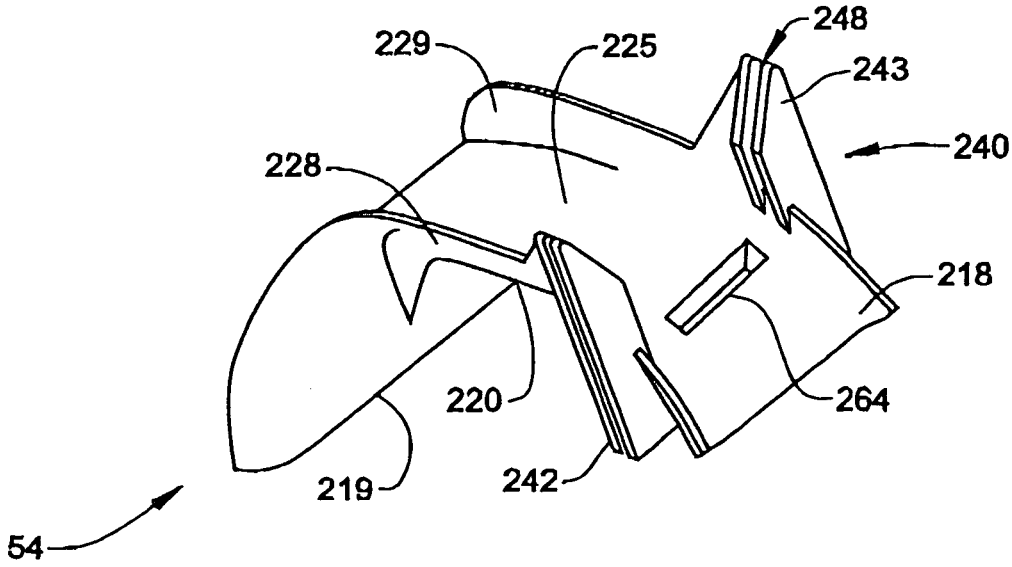
FIG. 4 is a perspective view of another anti-kink device of the invention.
Figure 6:
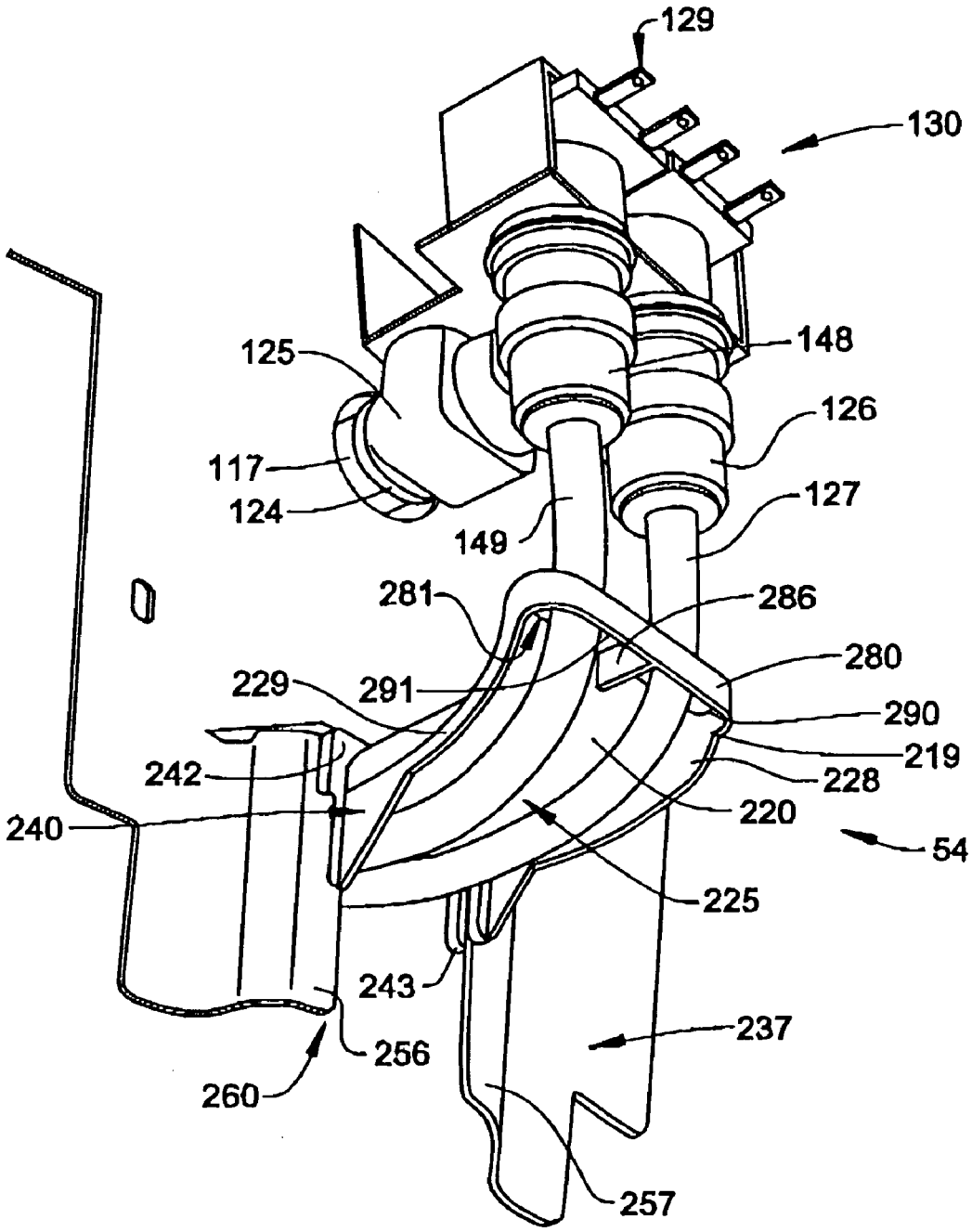
FIG. 6 is a perspective view of a dual water valve unit incorporating the anti-kink device of FIG. 4.
Figure 7:
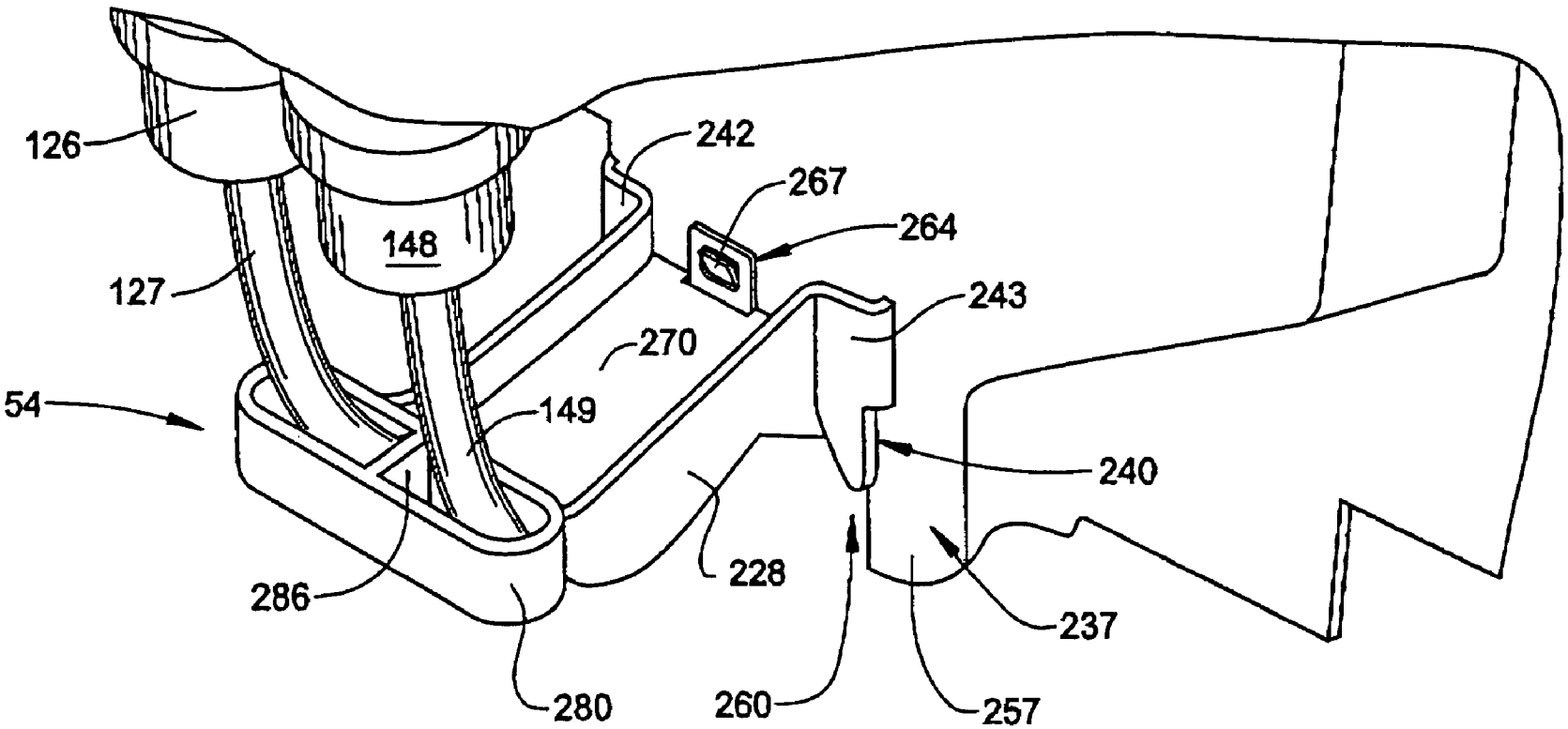
FIG. 7 is an upper perspective view of the anti-kink device of FIG. 4 shown mounted to the dual water valve unit.

Reference will now be made to FIGS. 4, 6 and 7 in describing second anti-kink device 54 constructed in accordance with a preferred embodiment of the present invention. As shown, anti-kink device 54 includes a first end portion 218 extending to a second end portion 219 through an arcuate center section 220. Center section 220 actually defines a trough section 225 having first and second upstanding wall members 228 and 229 that guide and align water lines 127 and 149 relative to dual valve 126.

In a manner similar to that described above, anti-kink device 54 is secured to a bracket 237, which is used to mount dual valve 126, through an integrally formed mounting member 240. Mounting member 240 includes first and second finger elements 242 and 243 which extend about trough section 225 and are cantilevered from center section 220. First and second finger elements 242 and 243 are spaced from one another establishing a channel 248. In accordance with the invention, anti-kink device 54 is secured to bracket 237 in manner similar to that described above with respect to anti-kink device 52. More specifically, as best shown in FIG. 6, bracket 237 includes first and second extension members 256 and 257 that are spaced from one another so as to define a slot 260. Mounting member 240 is positioned in slot 260 such that first and second finger members 242 and 243 sandwich a portion of bracket 237. Additionally, anti-kink device 54 is provided with a snap element 264 that receives a tab 267 that projects from bracket 237 at slot 260 to further aid in positioning and retaining anti-kink device 54. Snap element 264 projects from a rear surface 270 of center section 220 and provides a resilient attachment point for anti-kink device 54.

In accordance with the most preferred form of the invention, anti-kink device 54 is integrally molded of plastic and formed with a guide wall 280 that extends laterally across second end 219. Actually, guide wall 280 is spaced from second end 219 to establish a guide channel 281. Guide wall 280 is further connected to second end 219 through a divider wall 286 that divides guide channel 281 into first and second guide passages 290 and 291. With this preferred arrangement, water lines 127 and 149 extend along trough section 225 between upstanding wall members 228 and 229 and through first and second guide passages 290 and 291 respectively, before terminating at first and second outlets 126 and 148 of dual valve 125. This arrangement ensures that water lines 127 and 149 pass through slot 260 without becoming kinked prior to terminating at dual valve 125. In addition to ensuring an unobstructed flow of water, anti-kink device 54 ensures proper water line/valve alignment such that water lines 127 and 149 do not experience side loading when attached to outlets 126 and 148 respectively.

Figure 8:
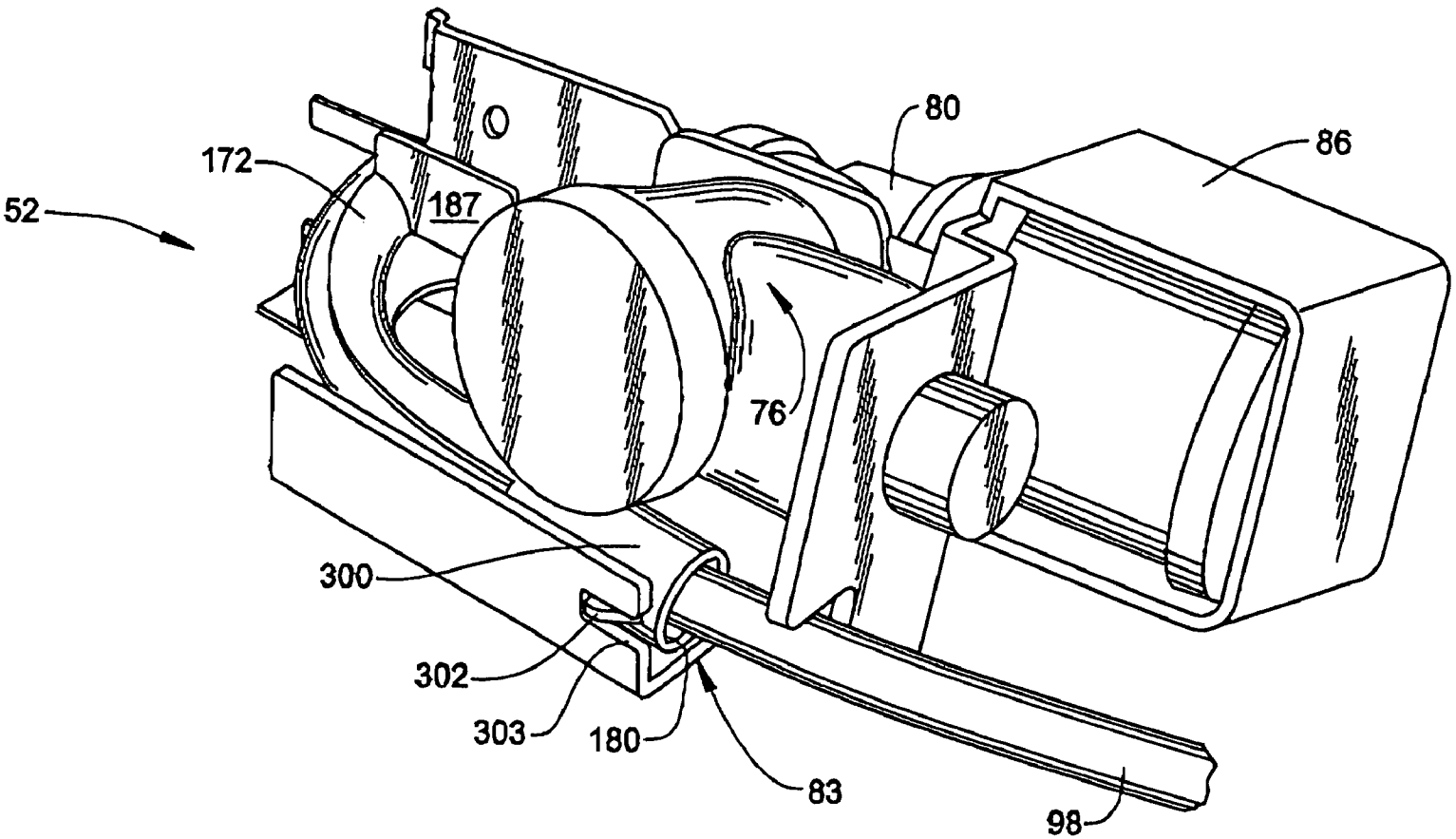
FIG. 8 is a perspective view of the anti-kink device of FIG. 3 incorporating an alternative guide channel arrangement.

At this point, it should be understood that each anti-kink device constructed in accordance with the present invention will prevent kinks from developing in one or more water lines of a water delivery system in a refrigerator, particularly at connection locations to valves. Although described with reference to preferred embodiments, it should be readily apparent that various changes and/or modifications can be made to the present invention without departing from the spirit thereof. For example, anti-kink device 52 could be formed so that at least a portion of trough 180 is fully enclosed so as to form a guide conduit 300 as illustrated in the embodiment of FIG. 8. With this particular arrangement, guide conduit 300 is shown to include a projection 302 that extends into a notch 303 formed on bracket 83. Projection 302 serves to fully constrain guide conduit 300 relative to bracket 83 to provide a more resilient mounting arrangement. Certainly, although described with reference to a side-by-side refrigerator, the water dispensing system and with the anti-kink device(s) of the invention could be used on various styles of refrigerators. Depending on the features of the refrigerator, anti-kink devices 52 and 54 could be employed individually or in combination. In any event, the invention is only intended to be limited by the scope of the following claims.

The invention claimed is:

1. A refrigerator comprising:

a cabinet;

at least one of a water dispenser and an icemaker; and a system for delivering water to the at least one of the water dispenser and the icemaker, said water delivering system including:

a valve adapted to receive a supply of water;

a bracket supporting the valve in relation to the cabinet;

a water line including a first end portion having a terminal end connected to the valve and a second end portion leading to the at least one of the water dispenser and the icemaker; and an anti-kink device mounted to the bracket, said anti-kink device including an arcuate section, wherein the first end portion of the water line is routed along the arcuate section.

2. The refrigerator according to claim 1, wherein the anti-kink device includes a first end portion and a second end portion connected through the arcuate section, said arcuate section defining at least a portion of a center section of the anti-kink device.

3. The refrigerator according to claim 2, wherein the anti-kink device included a trough extending from the first end portion to the second end portion, said water line being routed within the trough.

4. The refrigerator according to claim 3, wherein a portion of the trough is fully enclosed so as to form a guide conduit.

5. The refrigerator according to claim 4, further comprising: a projection extending from the guide conduit, said projection being adapted to engage with the bracket to constrain movement of the anti-kink device.

6. The refrigerator according to claim 2, wherein the anti-kink device includes a mounting member extending from the center section, said anti-kink device being connected to the bracket through the mounting member.

7. The refrigerator according to claim 6, wherein the mounting member includes first and second finger elements cantilevered from the center section.

8. The refrigerator according to claim 7, wherein said first and second finger element are spaced from each other so as to form a channel, said first and second finger elements spanning a portion of the bracket with the portion of the bracket extending into the channel.

9. The refrigerator according to claim 8, wherein the bracket includes first and second spaced extension members defining a slot there between, said mounting member being received in the slot.

10. The refrigerator according to claim 9, wherein the first end portion of the water line extends within the slot.

11. The refrigerator according to claim 2, wherein the anti-kink device is substantially U-shaped.

12. The refrigerator according to claim 2, wherein the anti-kink device includes a guide wall extending laterally across and spaced from the second end portion so as to form a guide channel, said first end portion of the water line passing through the guide channel.

13. The refrigerator according to claim 12, wherein the anti-kink device includes a wall extending between the guide wall and the second end portion, said wall dividing the guide channel into first and second guide passages, the first end portion of the water line passing through the first guide passage.

14. The refrigerator according to claim 13, wherein the system for delivering water further includes:

another valve adapted to receive a supply of water, said another valve being supported by the bracket; and another water line including a first end portion having a terminal end connected to the another valve, wherein the first end portion of the another water line is routed along the arcuate center section of the anti-kink device and passes through the second guide passage.

15. The refrigerator according to claim 2, further comprising:

a snap element projecting from the center section of the anti-kink device; and a tab extending from the bracket, said snap element engaging the tab to further mount the anti-kink device to the bracket.

16. A method of delivering water to at least one of a water dispenser or an icemaker in a refrigerator through a valve mounted on a bracket comprising:

connecting an anti-kink device to the bracket;

routing an end portion of a water line along an arcuate portion of the anti-kink device; and interconnecting a terminal end of the water line to the valve.

17. The method of clam 16, wherein the anti-kink device is connected to the bracket at the arcuate portion.

18. The method of claim 16, further comprising: sandwiching a portion of the bracket between finger elements extending from the anti-kink device to connect the anti-kink device to the bracket.

19. The method of claim 18, further comprising: positioning finger elements in a slot formed in the bracket.

20. The method of claim 19, further comprising: routing the water line through the slot.

21. The method of claim 16, further comprising:

routing an end portion of another water line along the arcuate portion of the anti-kink device; and connecting a terminal end of the another water line to the valve.

22. The method of claim 21, further comprising: routing each of the water line and the another water line through divided passages formed in the anti-kink device.

23. The method of claim 16, further comprising: snap-fittingly connecting the anti-kink device to the bracket.

* * * * *